United States Patent [19]

Choi

[11] 4,116,823

[45] Sep. 26, 1978

[54] VESSEL FOR STRIPPING OIL FROM FLUIDIZED ASH AND CHAR PARTICLES

[75] Inventor: Charles K. Choi, Claremont, Calif.

[73] Assignee: Occidental Petroleum Corporation, Los Angeles, Calif.

[21] Appl. No.: 719,274

[22] Filed: Aug. 31, 1976

Related U.S. Application Data

[63] Continuation-in-part of Ser. No. 603,874, Aug. 11, 1975, abandoned.

[51] Int. Cl.[2] ..... B07B 9/02

[52] U.S. Cl. ..... 209/44; 209/138; 209/474; 201/2.5; 201/31; 202/121; 196/127

[58] Field of Search ..... 201/13–16, 201/2.5, 3, 12, 22, 31, 39, 42; 209/138, 139 R, 140, 141, 11, 474–477, 44, 36, 37, 495, 494; 23/288 S; 34/10, 57 A; 208/127, 150, 151, 163, 164; 202/121; 196/127; 259/4 R, DIG. 17

[56] References Cited

U.S. PATENT DOCUMENTS

| | | | |
|---|---|---|---|
| 2,621,118 | 12/1952 | Cyr et al. | 34/10 X |
| 2,723,883 | 11/1955 | Lapple | 208/163 X |
| 2,862,871 | 12/1968 | Smith | 208/127 X |
| 2,929,774 | 3/1960 | Smith | 23/288 S X |
| 3,102,092 | 8/1963 | Heath et al. | 209/474 X |
| 3,206,392 | 9/1965 | Scheuermann et al. | 209/138 X |
| 3,627,129 | 12/1971 | Hartmann et al. | 209/474 |

FOREIGN PATENT DOCUMENTS

| | | | |
|---|---|---|---|
| 629,179 | 10/1961 | Canada | 208/127 |
| 685,930 | 1/1953 | United Kingdom | 209/474 |

*Primary Examiner*—Frank W. Lutter
*Assistant Examiner*—Ralph J. Hill
*Attorney, Agent, or Firm*—Christie, Parker & Hale

[57] ABSTRACT

A vessel is provided for stripping oil from char particles of different density recovered from a pyrolysis of organic solid waste. The lower end of the vessel is of reduced diameter with a plurality of gas jets which direct gas inwardly and upwardly to direct stripping gas through the particles. A standpipe extends upwardly from the bottom of the vessel and terminates above the gas inlet jets. A gas outlet is provided at the top of the vessel. The particles are introduced at an intermediate level in the vessel. The top of the standpipe is covered with a screen mesh for limiting the size of particles which can enter the standpipe. The gas fluidizes the particles of different density which tend to concentrate at different levels in the fluidized bed because of their density differences. The standpipe terminates at a selected level within the fluidized particle bed which results in a desired mixture of the particles of different density being withdrawn from the fluidized bed through the standpipe.

12 Claims, 2 Drawing Figures

VESSEL FOR STRIPPING OIL FROM FLUIDIZED ASH AND CHAR PARTICLES

CROSS REFERENCE TO RELATED APPLICATION

This is a continuation-in-part of my Application Ser. No. 603,874, filed Aug. 11, 1975, now abandoned.

FIELD OF THE INVENTION

This invention relates to apparatus for use in a flash pyrolysis system for disposing of solid waste, and more particularly, is concerned with a vessel for stripping oil from and fluidizing particulate inorganic heat source and particulate carbon containing solid residue of pyrolysis recovered from the pyrolysis of organic solid waste. This vessel also serves as a surge vessel for the mixture particles before they are transferred to a burner. The surge capacity is a very important function to provide smooth circulation of solids.

BACKGROUND OF THE INVENTION

The disposal of waste both from municipal and industrial sources, such as trash, rubbish, garbage, animal wastes, agricultural wastes, and waste of plastic processing operations is rapidly becoming of immense national concern. The cost of disposal ranks third behind public schooling and highways as municipal expense in the United States.

It is estimated that each individual in the country generates between 4 and 6 pounds of waste per day, that the industrial output is equivalent to approximately 5 pounds of solid waste per person per day. Previous methods of mass waste disposal, such as landfill, are becoming impossible, while others such as incineration are costly and result in air pollution problems.

A vast majority of the waste which is presently disposed of contains products which are immediately recyclable back into the economy or products into which the waste can be converted for recycle back to the economy. Directly recyclable constituents are the various metals present, such as aluminum and steel, and glass. For the most part, the organic solid waste fraction is subjected to flash pyrolysis as an operation independent of recovery of the directly recyclable inorganic fraction and any organic portion recovered as pulp. Flash pyrolysis in the presence of an inorganic heat source or ash yields carbon containing solid residue or char, condensible pyrolytic oils and combustible gases. The solid particles are removed from the liquid and gas constituents mechanically by cyclone separators. The oil and gas are valuable by-products, part of the gas being recycled to provide energy to the system.

After separation, it is necessary to fluidize the solid particles by mixing them with recycled product gas and direct them into a combustion chamber where the particles are mixed with a source of oxygen, typically air and cause decarbonization of the carbon containing solid residue of pyrolysis to reheat the inorganic heat source and generate from the carbon containing solid residue of pyrolysis additional inorganic heat source. However, before the particles can be fluidized, they must be stripped of any residual oil which tends to make the particles stick together and also to recover the oil before combustion takes place.

SUMMARY OF THE INVENTION

The present invention is directed to a vessel which receives particles of different density from cyclone separators, fluidizes the particles with gas, strips the particles of any residual oil, and passes on particles in the desired size and proportion of the particles of different density.

This is achieved, in brief, by providing a vessel having an elongated vertical chamber with conduit means for directing a mixture of particles downwardly into the chamber and releasing them into the chamber at an intermediate level at approximately the level of fluidized bed of the particles in the chamber. A gas is directed into a lower smaller diameter end of the chamber through a plurality of vertically directed jets of gas and a plurality of horizontally directed jets which agitate and fluidize the particles as they accumulate at the bottom of the chamber. A standpipe, preferably covered with a screen mesh, removes the fluidized gas particles at an intermediate level at which the proportion of the particles of different density is in the desired range. An outlet is also provided at the top of the chamber for removing gas and any extremely fine particles which escape the fluidized bed for recirculation through the cyclone separators.

Applied to the pyrolysis of solid waste, the apparatus serves a significant function in providing particles of different density and character to a decarbonization zone. In the process, particulate organic solid waste is pyrolyzed in the presence of a hot solid inorganic heat source transported with the waste through a flash pyrolysis zone by a carrier gas which is nondeleteriously reactive with respect to the products of pyrolysis. Pyrolysis yields a low density carbon containing solid residue of pyrolysis, pyrolytic oils and gases. These combined with the higher density particles of inorganic solid heat source pass through one or more cyclone separators which remove the particles of different density of the vapor stream. Some pyrolytic oils are entrained by the particles.

The particles are conducted to a fluidized bed of the particles contained in a vessel which provides a gas expansion zone above the fluidized bed. Jets of gas are injected into the base of the bed to fluidize the particles and strip entrained oil from the surface of the particles. Agitation prevents segregation of the low density particles of carbon containing solid residue of pyrolysis of the particulate inorganic solid heat source. The desired mixture of the two particles are withdrawn from a point central of the fluidized bed and passed to a decarbonization zone. In the decarbonization zone, the carbon containing solid residue of pyrolysis is oxidized to heat the inorganic solid heat source and form from decarbonization additional inorganic solid heat source for recycle to the flash pyrolysis zone.

DESCRIPTION OF THE DRAWINGS

For a more complete understanding of the invention, reference should be made to the accompanying drawing, wherein.

DETAILED DESCRIPTION

Figure 1:
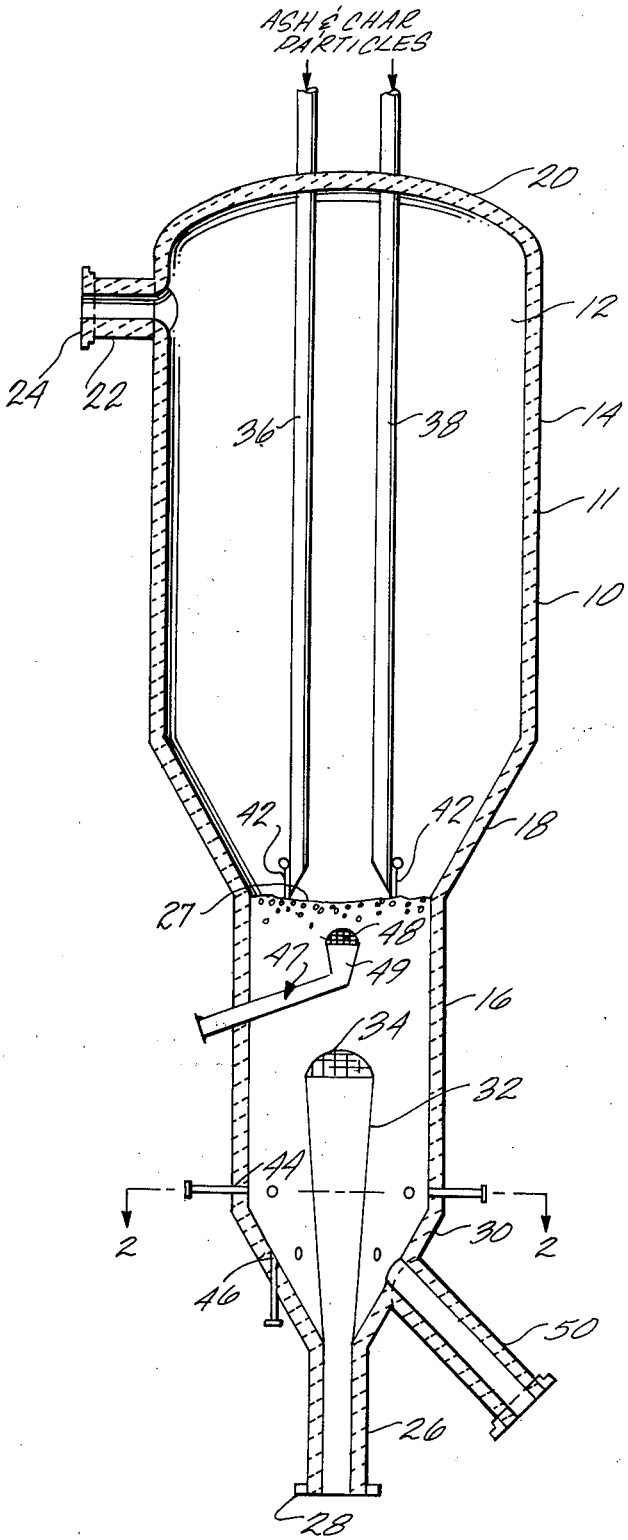
FIG. 1 is an elevational view in section of the vessel.
Figure 2:
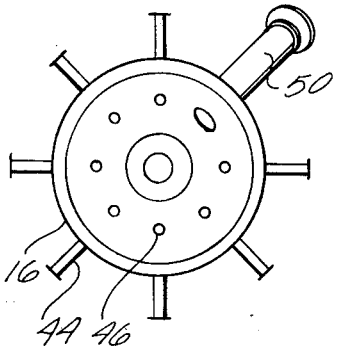
FIG. 2 is a cross-sectional view taken along the line 2—2 of FIG. 1.

Stripper vessels provided in accordance with this invention find particular utility in the pyrolysis of solid organic waste. Pyrolysis occurs in a transport flash pyrolysis reactor.

The organic solid wastes which undergoes pyrolysis is the predominately organic portion remaining after gross separation of the inorganic constituents from the as received waste. Because of the several comminuting operations attendant to the gross separation, there appear in the organic solid waste fraction some inorganic solid fines. The fines are predominately glass. These inorganics, except for lost or removed fly ash, become a particulate solid heat source or "ash" formed upon decarbonization of the carbon containing solid residue of pyrolysis as described below.

The "organic" constituents of the organic solid wastes include cellulosic materials, plastic, rubber stock, and animal waste. Included in the meaning of "cellulosic materials" are paper, tree trimmings and bark, sawdust, crop waste, vegetable and fruit processing waste, and the like. "Plastics" include discarded household plastics, as well as the waste of industrial polymer forming and processing operations. "Rubber stock" includes waste tires. "Animal wastes" include household discards, slaughterhouse wastes, poultry processing wastes, manure, and the like.

The organic solid waste may have, after drying to the extent required preparatory to a pyrolysis, the following typical analysis:

Table 1

| Constituent | % by Weight |
|---|---|
| Organics | 92.29 |
| Metals | 0.38 |
| Glass | 1.69 |
| Other Inorganics | 2.02 |
| Water | 3.62 |

When the organic solid waste is pyrolyzed, there is formed a mixture of a carbon containing solid residue of pyrolysis, termed herein "char", pyrolytic oils and gas. The gas includes transport gas and gases resulting from pyrolysis. The gas on a dry basis consists primarily of the oxides of carbon, hydrogen and light hydrocarbons.

The carbon containing solid residue of pyrolysis, or "char", contains combustibles which are carbonaceous in nature, the main constituent of which is carbon, in intimate admixture with particulate inorganics. The carbon containing solid residue of pyrolysis, depending on the waste source, may contain from about 50 to about 70% inorganics, the balance being carbonaceous in nature, i.e. mainly carbon with some bound hydrogen, and oxygen being present. Bulk density of the char is low, ranging from about 5.5 to 12.5 lbs./cu. ft.

The inorganic solid heat source or "ash" which is formed by decarbonization of the char and in contrast to the char, has a high bulk density between about 55 and 70 lbs./cu. ft. Its hard, glass like nature makes an ideal particulate heat source which is readily generated from within the process itself. The ash has a sintering temperature between about 1400° and about 1700° F. and a particle and skeletal density of about 150 lbs./cu. ft. When used as a heat source a major quantity of "fly ash" is removed.

The "pyrolytic oils" formed while varying in nature depending upon the composition of the waste material processed and pyrolysis conditions employed are at the same time unique. They may be characterized as an oxygenated, complex organic fluid, typically up to 40% and in some cases up to about 90% soluble in water, acids or base. A typical example of an elemental analysis of the pyrolytic oil is that obtained from the pyrolysis of a waste material containing about 70% cellulosics. The oil thus obtained will contain from about 40 to about 60% carbon, from about 5 to about 10% hydrogen, from about 1 to about 2% nitrogen and from about 20 to about 40% oxygen. The empirical formula which best fits the pyrolytic oil analysis is $C_5H_8O_2$. Specific gravities range from about 1.1 to about 1.4.

A nondeleteriously reactive carrier gas is a gas stream which is essentially free of free oxygen. Although constituents may react under nonoxidizing conditions with pyrolysis products to upgrade their value, to be avoided are constituents which degrade pyrolysis products.

As indicated, flash pyrolysis yields the carbon containing solid residue of pyrolysis in admixture with the inorganic heat source, pyrolytic oils and gases. The mixture passes through one or more cyclone separators when the particles are separated, with some entrained oils from the vapor stream.

It is necessary to proper operation of the system to collect these particles of different density, strip oil from their surface and transfer them to a decarbonization zone. In the decarbonization zone, the carbon containing solid residue of pyrolysis is decarbonized in the presence of a source of oxygen, typically air. The heat released is used to heat the inorganic solid heat source particles back to a temperature suitable for introduction to the pyrolysis zone. Decarbonization yields additional particles of the inorganic heat source.

It is essential that the carbon containing solid residue of pyrolysis and inorganic solid heat source be provided to the decarbonization zone in proper proportions. This is to provide enough carbon to heat the solids upon decarbonization; avoid excess heat through an over supply of carbon containing solid residue which can produce too much heat and sinter the inorganic solid heat source particle and produce a deficiency of the carbon containing solid residue causing resort to an external fuel to generate the heat required.

It is to achieve this balance of feed to the decarbonization zone that the apparatus of this invention is provided. In addition, the apparatus must serve to strip particles of entrained oil to insure free flowing transfer to the decarbonization zone.

Referring now to the drawings in detail, the numeral 10 indicates generally the outer wall of the housing which is made of metal pipe and lined with a layer of refractory material 11. The vessel includes an upper cylindrical portion 14 and a lower cylindrical portion 16 of smaller cross-sectional area joined by a frustoconical section 18. The upper end is enclosed by a dome-shaped top 20. An outlet pipe 22 terminating in a coupling flange 24 extends out from the upper end of the upper cylindrical portion 14. The lower end of the vessel terminates in an outlet pipe 26 having a coupling flange 28, the lower outlet pipe extending downwardly along the central axis of the vessel. A lower frustoconical section 30 extends between the lower cylindrical portion 16 and the outlet pipe 26.

Positioned in the lower end of the vessel is a particles outlet conduit such as standpipe 32 which is slightly tapered from the lower end to engage the ceramic lining at the upper end of the outlet pipe 26. The upper end of the standpipe 32 terminates in a screen 34 having a mesh size which excludes particles that are too large to be fluidized effectively.

To introduce the particles into the vessel, one or more particles inlet conduit, such as indicated at 36 and 38, are provided. These conduits extend downwardly through the top 20 of the vessel 10 and terminate adjacent the upper end of the lower section 16 of the vessel to provide a point of discharge. These conduits are normally adapted to form the diplegs from a pair of cyclone separators (not shown) mounted above the vessel. The lower end of the pipes are provided with means such as flap valves 40 and 42 which are opened by the weight of particles accumulating in the pipes but which are closed by any back pressure tending to reverse the downward flow of the particles and gas into the conduits so as to disturb operation of the cyclones.

Aeration of the particles in the vessel is accomplished by two groups of nozzles providing jets of gas. One group includes a plurality of horizontal nozzles 44 which extend through the lower section 16 of the vessel. Typically eight such nozzles are angularly spaced around the inner periphery of the vessel wall. A second group of nozzles, indicated at 46, extend vertically into the vessel through the lower frustoconical section 30. A plurality of such nozzles 46 are angularly spaced around the inner periphery of the vessel wall. Both the horizontal set of nozzles 44 and the vertical set of nozzles 46 are connected to a high pressure source of a gas which is nondeleteriously reactive with respect to the contained particles, preferably recycled product gas from the solid waste disposal system. The gas jets produce sufficient velocity in the lower end of the vessel to suspend particles and maintain them in a fluidized state. As the gas moves upwardly into the larger diameter upper section 12 of the vessel, the velocity of the gas is greatly reduced so as to minimize entrainment of the particles in the gas as it leaves the vessel through the outlet pipe 22. By a suitable valve means (not shown) in the outlet line coupled to the lower outlet pipe 26, the level of the particles in the vessel is maintained level 27 with the top of the lower section 16.

As the gas passes upwardly through the particle bed in the lower end of the chamber, the gas by reason of its elevated temperature (500° F.) purges any residual oil from the particles. The gas, oil, and some of the very fine particles pass out through the outlet 22. These can be recycled for separation and recovery of the particles to enable their return to the vessel.

The standpipe 32 is arranged to terminate at its upper end at an intermediate level in the particle bed within the lower section 16. Because the inorganic heat source or "ash" particles are of higher density than the particles of carbon containing solid residue of pyrolysis or "char", they tend to concentrate in the lower portion of the bed while the lower density char particles tend to concentrate near the upper level of the bed. By locating the top of the standpipe at an intermediate level, the desired mixture of ash and char particles is syphoned off from the vessel for feed to a decarbonization zone (not shown). The shorter the height of the standpipe, the greater percentage of ash particles in the output stream, whereas the longer the standpipe, the greater the percentage of char particles in the output mix.

In some instances, if the density or ratio of char to ash is lower then usual, the concentration of char entering the standpipe 32 may be too low. An auxiliary outlet 47 is provided for this purpose. The outlet 47 includes a screen 48 and an outlet pipe 49 which extends through the cylindrical portion 16. The pipe angles downwardly to aid in movement of the char particles from the vessel.

A separate outlet pipe may be provided, as indicated at 50, in the lower end of the vessel for purging the vessel of any large particles of solid material that may in time collect in the bottom of the vessel. A valve (not shown) is connected to the outlet 50 which is normally closed.

What is claimed is:

1. Apparatus for collecting particles of different densities, stripping said particles of entrained fluids and providing a mixture of said collected particles for feed to another apparatus, which comprises:

(a) a housing providing an elongated vertical chamber having an upper end including a top and a lower end;

(b) at least one particles inlet conduit extending from said top downward into the chamber terminating at a point of discharge within the chamber, said particles inlet conduit for transferring particles collected external of the chamber downward to and into the chamber to form a bed of particles extending from said lower end to said point of discharge;

(c) a gas exhaust outlet at the upper end of the chamber;

(d) means for directing a flow of gas from said lower end through the contained bed of particles to fluidize said particles and strip said particles of entrained fluid;

(e) means included on said particles inlet for preventing flow of particles and gas upwards in said conduit;

(f) a first particles outlet conduit extending from the lower end of said chamber upward to a point of particles removal intermediate between said lower end and said point of discharge and providing at said point of particles removal, an opening for receiving a mixture of said particles of different densities;

(g) valve means associated with said particles outlet conduit for controlling the level of the bed of particles contained in the chamber; and (h) a second particles outlet conduit extending from the side of said chamber to a point between said point of particles removal and said point of discharge and providing a second opening for receiving particles.

2. Apparatus of claim 1 further including a screen mesh over the opening of the first particles outlet for receiving said mixture of particles to limit the size of the particles entering the opening.

3. Apparatus of claim 1 further including a screen mesh over said second opening.

4. Apparatus of claim 1 in which the chamber is formed of a lower portion and an upper portion, the upper portion being of greater cross-sectional area than the lower portion and having an upper end formed to a lower end of the upper portion wherein said particles inlet conduit terminates to provide the point of discharge at about the upper end of the lower portion.

5. Apparatus of claim 1 wherein the means for directing a flow of gas into the lower end of the chamber includes a plurality of vertically extending conduits terminating inside the chamber below the top of said outlet conduit and through which the gas is directed upwardly into the chamber.

6. Apparatus of claim 5 wherein the means for directing a flow of gas into the chamber further includes a plurality of horizontal pipes terminating inside the chamber below the top of the outlet conduit and adjacent the vertically extending conduits.

7. A vessel for stripping oil from a high density particulate inorganic heat source and a low density particulate carbon containing solid residue of pyrolysis recovered from the pyrolysis of solid organic waste and provide a mixture of said particles for feed to a zone to decarbonize the carbon containing solid residue of pyrolysis and generate the particulate heat source comprising:

(a) an upper cylindrical chamber having an upper end including a top;

(b) a lower cylindrical chamber of smaller diameter than the upper chamber connected to the upper chamber and having a lower end;

(c) at least one particles inlet conduit adapted at one end for coupling to a cyclone separator and extending from such end through the top of the upper chamber to the lower chamber for admitting the particles of said inorganic heat source and carbon containing solid residue of pyrolysis into the lower chamber of the vessel;

(d) a plurality of gas jets opening into the lower end of the lower chamber for admitting a gas to fluidize particles and strip oil from said particles;

(e) flap means coupled to said particles inlet conduit to prevent backflow of gas and particles in said conduit;

(f) an upper gas outlet pipe at the upper end of the upper chamber;

(g) a portion of a standpipe extending upwardly from said lower end into the lower chamber to an intermediate point between the gas jets and the particles inlet conduit, the standpipe having an opening for receiving a mixture of particles of inorganic heat source and carbon containing solid residue of pyrolysis and char fluidized by gas admitted through the jets;

(h) valve means associated wih the standpipe for controlling the level of particles within the vessel; and (i) a particles removal conduit extending from the side of the lower cylindrical chamber to a point between the point of extension of the standpipe into the vessel and particles inlet conduit and providing a second opening for receiving and particles.

8. The vessel of claim 7 further including a screen mesh over the opening of the standpipe to limit the size of the particles entering the opening.

9. The vessel of claim 7 in which a screen mesh is provided over the second opening of the particles removal conduit to limit the size of the particles entering the opening.

10. Apparatus of claim 6 wherein a portion of the jets are horizontal and a portion of the jets are vertical.

11. Apparatus of claim 10 wherein the horizontal jets are positioned at a higher level in the vessel than the vertical jets.

12. Apparatus of claim 6 wherein the volume of the upper chamber is several times greater than the volume of the lower chamber to reduce the velocity of flow of the gas from the jets entering the upper chamber to the upper outlet pipe.

* * * * *

UNITED STATES PATENT AND TRADEMARK OFFICE

CERTIFICATE OF CORRECTION

PATENT NO. : 4,116,823

DATED : September 26, 1978

INVENTOR(S) : Charles K. Choi

It is certified that error appears in the above-identified patent and that said Letters Patent are hereby corrected as shown below:

Column 8, line 13, after "and" first occurrence, insert -- the--; line 14, delete "and" and insert therefor -- said --.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*